United States Patent [19]

Togoshi

[11] Patent Number: 5,010,758

[45] Date of Patent: Apr. 30, 1991

[54] BENDING MACHINE

[75] Inventor: Hideaki Togoshi, Nishinomiya, Japan

[73] Assignee: Chiyoda Kogyo Co., Ltd., Osaka, Japan

[21] Appl. No.: 494,892

[22] Filed: Mar. 12, 1990

Related U.S. Application Data

[63] Continuation of Ser. No. 267,675, Nov. 3, 1988, abandoned, which is a continuation of Ser. No. 813,337, Dec. 26, 1985, abandoned, which is a continuation-in-part of Ser. No. 761,626, Aug. 1, 1985, abandoned.

[30] Foreign Application Priority Data

Mar. 23, 1984 [JP] Japan ..... 59-42559
Nov. 22, 1985 [JP] Japan ..... 60-180475

[51] Int. Cl.[5] ..... B21D 7/04
[52] U.S. Cl. ..... 72/157; 72/159
[58] Field of Search ..... 72/149, 150, 155, 157, 72/158, 159, 384, 387

[56] References Cited

U.S. PATENT DOCUMENTS 4,063,441 12/1977 Eaton ..... 72/155 X
4,313,324 2/1982 Pearson ..... 72/149
4,495,788 1/1985 Traub ..... 72/157
4,503,694 3/1985 Takumi ..... 72/131

FOREIGN PATENT DOCUMENTS 1962590 6/1971 Fed. Rep. of Germany ..... 72/157
2910174 9/1980 Fed. Rep. of Germany ..... 72/157
2121756 8/1972 France ..... 72/384

*Primary Examiner*—E. Michael Combs
*Attorney, Agent, or Firm*—Jordan and Hamburg

[57] ABSTRACT

A bending machine comprising a feed mechanism and a bending assembly mounted on a base block for bending an elongate workpiece such as a pipe or the like. The feed mechanism includes a member for holding a rear portion of the workpiece, and the bending assembly includes a plurality of dies for bending a forward portion of the workpiece. The disclosed bending machine further comprises a first actuator provided between the bending assembly and the base block for moving the bending assembly on a bending plane, and a second actuator between the feed mechanism and the base block for moving the feed mechanism along a rotational axis of the dies.

13 Claims, 3 Drawing Sheets

(A)

(B)

(C)

BENDING MACHINE

This application is a continuation of application Ser. No. 267,675, filed Nov. 3, 1988 abandoned, which in turn is a continuation of application Ser. No. 813,337, filed Dec. 26, 1985 abandoned; which in turn is a continuation-in-part of application Ser. No. 761,626, filed Aug. 1, 1985 abandoned.

BACKGROUND OF THE INVENTION

The present invention relates to a bending machine for use in bending pipes such as oil pipes and iron bars and the like. More particularly, the invention relates to a bending machine comprising a feed mechanism mounted on a base block for advancing a length of workpiece to a bending section, and a bending assembly including a plurality of rotatable bend dies arranged along a common rotational axis and a plurality of clamp dies movable toward and away from the bend dies, the bend dies and the claim dies being adapted to hold the workpiece therebetween and bend the workpiece by rotating in unison about the rotational axis.

A bending machine as described above which comprises a bending assembly including a plurality of bend dies arranged along a common rotational axis is capable of bending elongate workpieces having varied diameters and bending such workpieces to varied curvatures by selecting suitable bend dies. In order to achieve this, however, the bending assembly and the workpiece must be movable relative to each other in directions on a bending plane of the workpiece and in directions along the rotational axis of the bend dies. According to a known construction, a first actuator for effecting the movements on the bending plane and a second actuator for effecting the movements along the rotational axis of the bend dies are both mounted on the base block. More particularly, the two actuators are provided between the feed mechanism and the base block to move the workpiece on the bending plane and along the rotational axis of the bend dies. However, where the movements on the bending plane is effected by means of the feed mechanism supporting the elongate workpiece, the positional adjustment of the workpiece tends to lack in precision although the movements along the rotational axis may be effected with no problem. Such precision cannot be assured because it is an attempt to control the position of a part of the elongate workpiece adjacent a leading end thereof by moving the feed mechanism which is holding a part of the elongate workpiece adjacent a tail end thereof. A bending operation to bend the workpiece by rotating the bending assembly without accurate positioning of the workpiece in the direction on the bending plane, would result in failure to achieve a desired bend angle.

As a solution to this problem a construction has been proposed as in Japanese Patent Publication No. 59-32410, for example. According to the proposed construction, the first and second actuators are both provided between the bending assembly and the base block. More particularly, a frame carrying the bending assembly is attached to the base block to be movable on the bending plane, and the first actuator is provided between this frame and the base block while the second actuator is provided between the frame and the bending assembly. This construction has the advantage of assuring accurate positioning of the workpiece on the bending plane since the bending assembly is moved on the bending plane. However, the second actuator must be moved together with the bending machine and therefore the devices to be moved are heavy, which gives rise to a new problem of lacking in speedy movement and hence poor working efficiency.

SUMMARY OF THE INVENTION

This invention has been made having regard to the above noted disadvantages of the prior art, and its object is to provide a bending machine having practical utility and capable of bending elongate workpieces to desired angles efficiently.

In order to achieve this object, a bending machine according to this invention is characterized in that the bending assembly is attached to the base block to be movable on a bending plane of the workpiece, a first actuator being provided between the bending assembly and the base block for moving the bending assembly on the bending plane, and the feed means is mounted on the base block to be movable in directions along the rotational axis of the bend dies, a second actuator being provided between the feed mechanism and the base block for moving the feed mechanism along the rotational axis of the bend dies.

Thus, the relative movements between the bending assembly and the workpiece on the bending plane are effected by moving the bending assembly, which assures accurate positioning of the workpiece on the bending plane. On the other hand, the relative movements along the rotational axis of the bend dies are effected by moving the feed mechanism, which permits the devices moved on the bending plane to be lightweight. As a result, the elongate workpiece such as a length of pipe may be bent to a desired angle efficiently.

Other features and advantages of this invention will be apparent from the following description.

BRIEF DESCRIPTION OF THE DRAWINGS

The drawings illustrate a bending machine embodying this invention, in which.

DESCRIPTION OF THE PREFERRED EMBODIMENT

Figure 1:
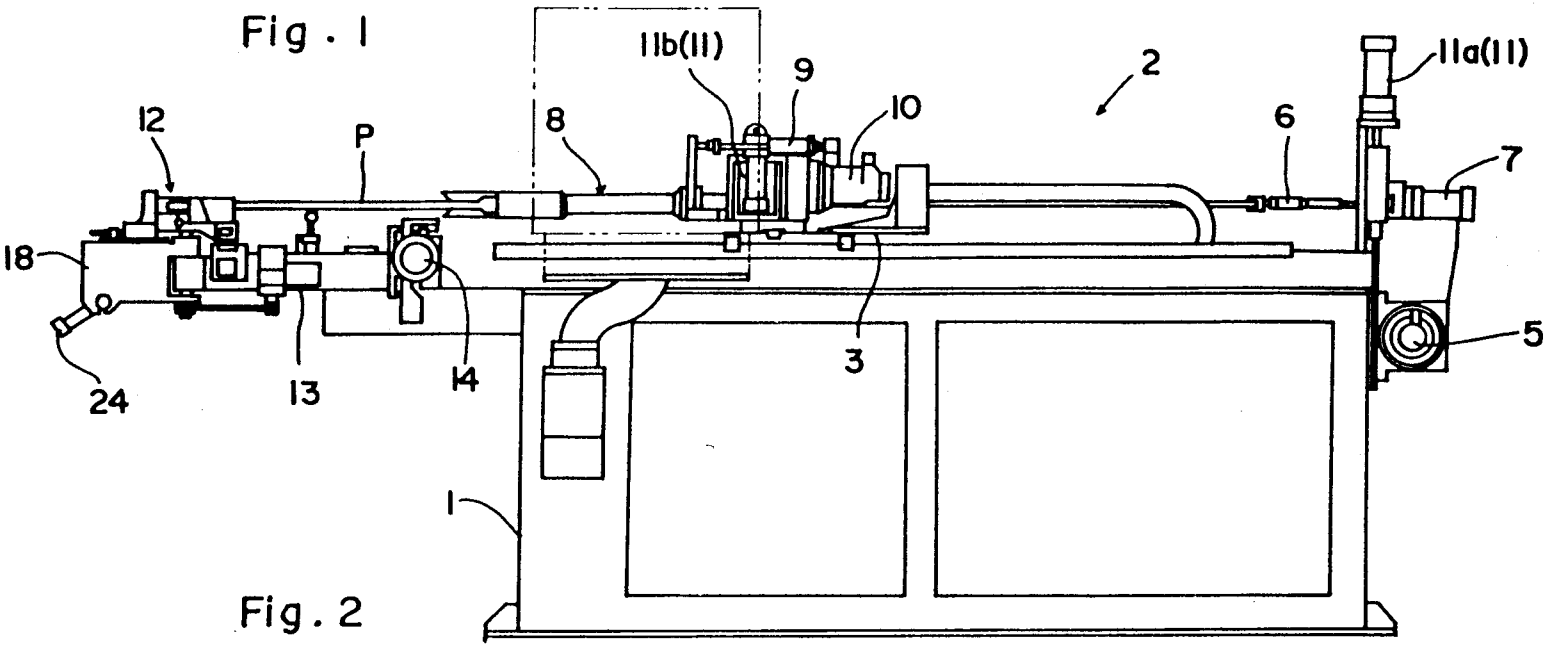
FIG. 1 is a side view of the bending machine.
Figure 2:
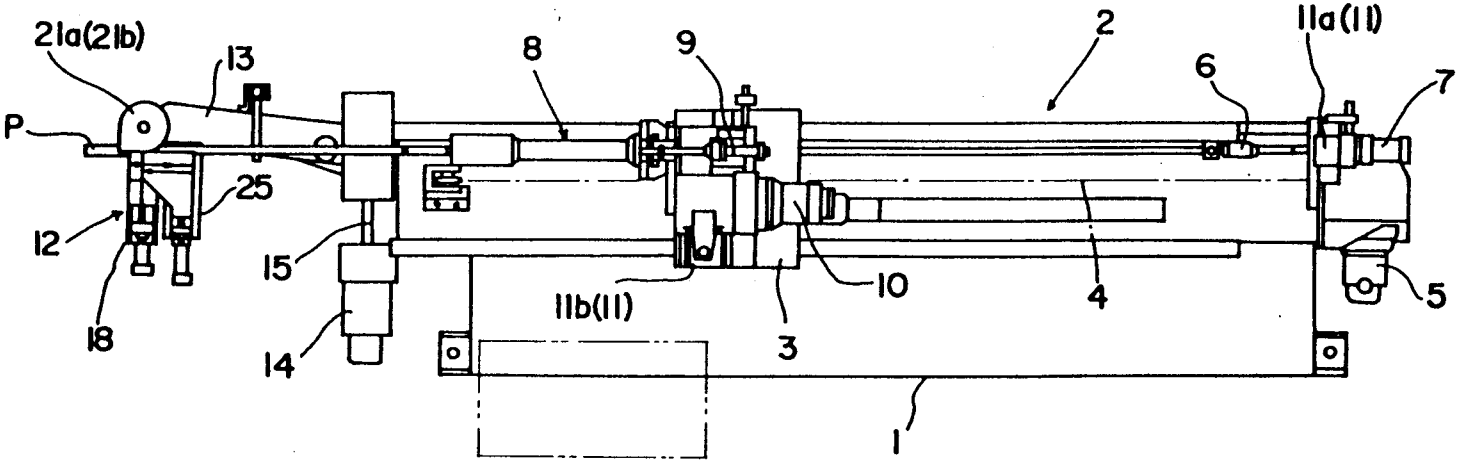
FIG. 2 is a plan view of the bending machine.

Referring to FIGS. 1 and 2, the bending machine shown therein comprises a base block 1 resting on a floor and a feed mechanism 2 mounted thereon for advancing a pipe P, which is an example of a length of workpiece to be bent, maintained in a horizontal posture to a bending section of the machine. The feed mechanism 2 includes a carriage 3 movable axially of the pipe P, a servomotor 5 for moving the carriage 3 by means of a chain 4, a mandrel 6 for supporting the pipe P by relatively rotatably fitting thereinto, a hydraulic cylinder 7 for moving the mandrel 6 axially of the pipe P. The carriage 3 carries a chuck 8 for receiving and holding an intermediate portion of the pipe P, a hydraulic cylinder 9 for switching the chuck 8 between a position to hold the pipe P and a position to release the pipe P, and a DC servomotor 10 for rotating the chuck 8 about the axis of the pipe P. The feed mechanism 2 in its entirety is mounted on the base block 1 to be vertically movable relative thereto. The feed mechanism 2 is forcibly moved up and down by a second actuator 11 comprising two hydraulic cylinders 11 provided between the feed mechanism 2 and the base block 1. One of the cylinders 11*a* is provided between the mandrel 6 and the base block 1 and the other 11*b* is provided between the carriage 3 and a combination of chuck 8 and DC servomotor 10. By an associated action of the cylinders 11*a* and 11*b* the feed mechanism 2 in its entirety is moved up and down.

The machine further comprises a frame 13 carrying a bending assembly 12 mounted on the base block 1 at a side opposite the side at which the mandrel 6 is mounted. The frame 13 and bending assembly 12 are forcibly movable horizontally relative to the base block 1 by a first actuator comprising a DC servomotor 14 provided between the bending assembly 12 and the base block 1. More particularly, as shown in FIG. 3, the servomotor 14 is fixed to the base block 1 and a ball nut 16 in mesh with a screw shaft 15 rotatable by the servomotor 14 is attached to the frame 13, so that the bending assembly 12 and the frame 13 are horizontally slidable in unison by rotations of the servomotor 14.

Figure 3:
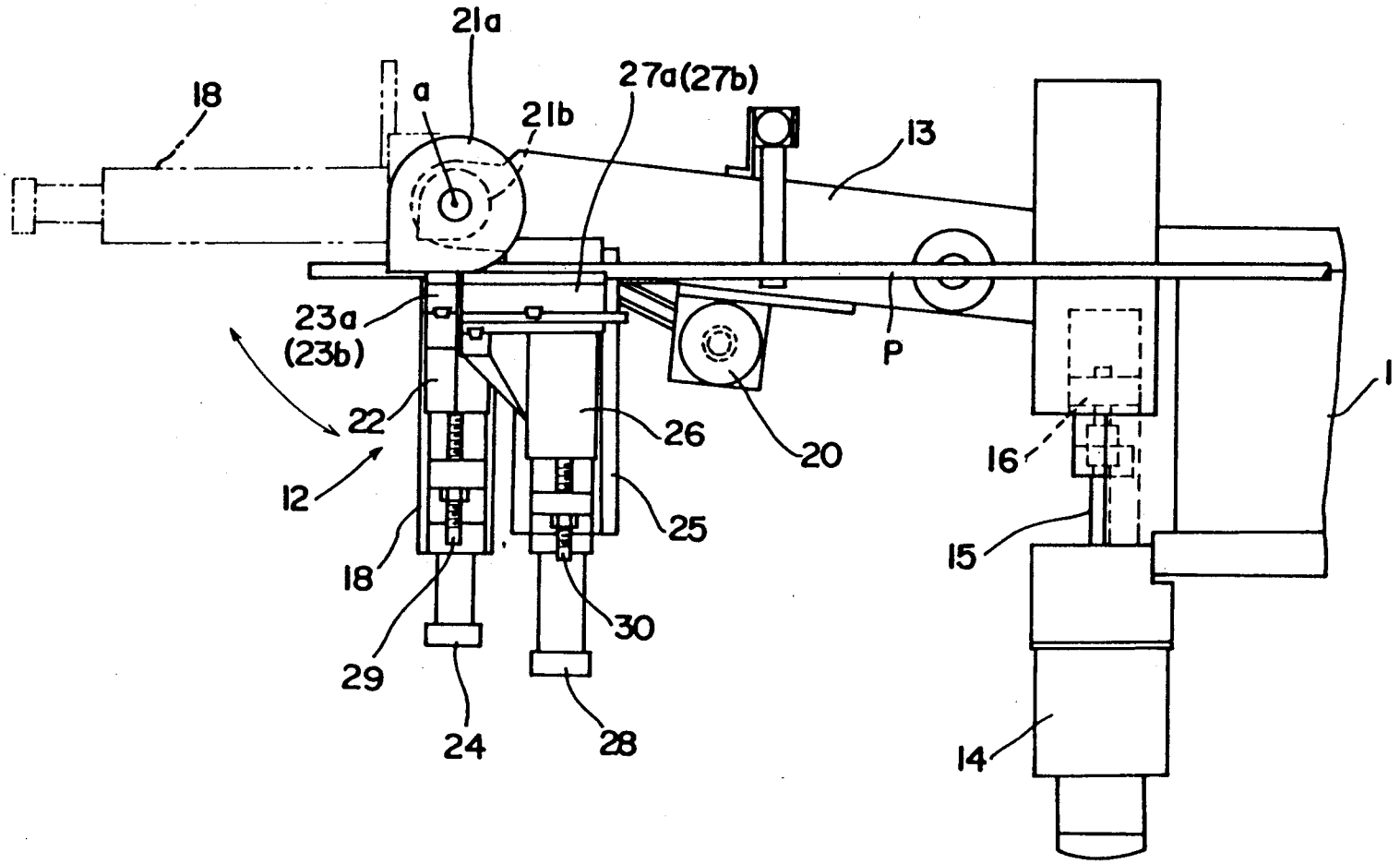
FIG. 3 is a plan view of a principal portion of the bending machine.
Figure 4:
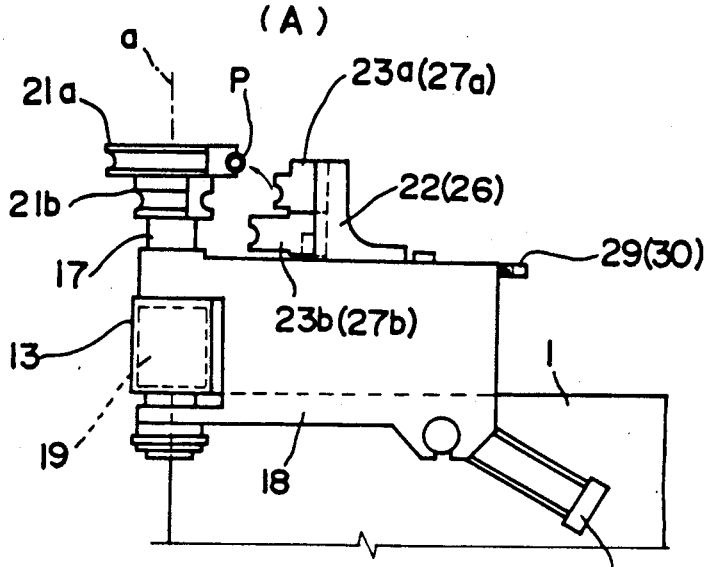
FIGS. 4*a*, 4*b* and 4*c* are front views of the principal portion in varied stages of operation.
Figure 4:
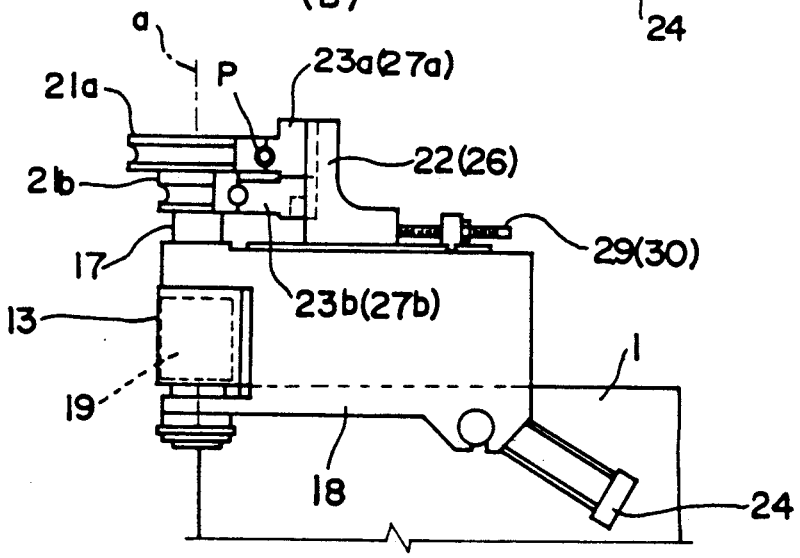
Figure 4:
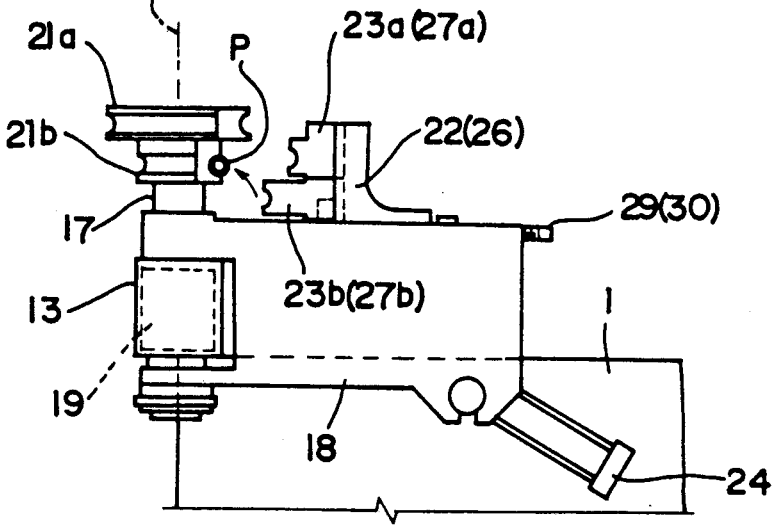

Referring to FIGS. 3 and 4, the frame 13 rotatably supports a vertical shaft 17 which in turn supports a swing frame 18 fixed thereto. The shaft 17 and swing frame 18 are swingable in unison relative to the frame 13 by action of a hydraulic motor 19. An encoder 20 is attached to the frame 13 to detect swing angles of the swing frame 18, namely bend angles of the pipe P. Two bend dies 21*a* and 21*b* are removably secured to the shaft 17 one on top of the other. These bend dies 21*a* and 21*b* are interchangeable with other bend dies as desired to enable bending of pipes having varied diameters and to enable the pipe P to be bent to varied curvatures. The swing frame 18 supports a carrier 22 mounted thereon by means of a link mechanism (not shown) to be movable toward and away from the bend dies 21*a* and 21*b*. Two clamp dies 23*a* and 23*b* are removably secured to the carrier 22 one on top of the other. A hydraulic cylinder 24 is provided to cause the bend dies 21*a* and 21*b* and clamp dies 23*a* and 23*b* to hold the pipe P therebetween and release the pipe P. The frame 18 carries a stationary frame 25 secured to a position closer to the base block 1 than is the swing frame 18. The stationary frame 25 supports a carrier 26 having the same function as the carrier 22. Two pressure dies 27*a* and 27*b* are removably secured to the carrier 26 one on top of the other to be operable by action of a hydraulic cylinder 28 to press the pipe P against the bend dies 21*a* and 21*b*. When the swing frame 18 is caused to swing with the bend die 21*a* or 21*b* and clamp die 23*a* or 23*b* holding the pipe P therebetween, these dies are rotated together through a desired angle about a rotational axis a of the shaft 17 whereby the pipe P is bent while being caused to slide relative to the pressure dies 27*a* and 27*b*. Thus, the bend dies 21*a* and 21*b* and clamp dies 23*a* and 23*b* constitute the bending assembly 12. Numbers 29 and 30 in the drawings denote screws for adjusting operative positions of the clamp dies 23*a* and 23*b* and pressure dies 27*a* and 27*b* according to a diameter of the pipe P and other conditions, respectively.

It will be understood that varied types of pipe having different diameters may be bent to desired curvatures by changing the bend dies 21*a* and 21*b*, as appropriate and deciding which should be placed on top of which. Relative movements between the bending assembly 12 and the pipe P in horizontal directions, namely in directions on a plane of pipe bending, are effected by the first actuator 14 disposed adjacent the bending assembly 12. This enables the position of pipe P relative to the bend dies 21*a* and 21*b* to be determined accurately for the achievement of high precision bending. Where a servomotor is employed as the first actuator 14 as described, its operation may be stopped at a desired position accurately and promptly, which contributes toward a high precision and speedy bending operation. Relative movements between the bending assembly 12 and the pipe P in vertical directions, namely in directions parallel to the rotational axis a of the bend dies 21*a* and 21*b*, are effected by the second actuator 11 disposed on the base block 1. This arrangement permits the mechanism for causing the horizontal relative movements to be lightweight to expedite the bending operation, as described in the introductory part of this specification.

I claim:

1. In a bending machine comprising a base block, a bending assembly, and means mounted on the base block for holding a length of a workpiece and advancing the workpiece in a first direction to the bending assembly, the bending assembly comprising means defining a rotational axis, a plurality of rotatable bend dies arranged along said rotational axis and a plurality of clamp dies movable toward and away from the bend dies, the bend dies and the clamp dies being adapted to hold the workpiece therebetween and bend the workpiece by rotating in unison about the rotational axis, the improvement comprising means for mounting said bending assembly to said base block for movement in a first plane perpendicular to and a first actuator coupled to said base block and means for mounting said bending assembly for moving the bending assembly in said first plane in a second direction transverse of said first direction, said means for holding and advancing being mounted on the base block to be movable in a third direction parallel to said rotational axis, and further comprising a second actuator, and means coupling said second actuator to said holding and advancing means and base block for moving the holding and advancing means in said third direction whereby a workpiece held by said feed means is moved in said third direction.

2. The bending machine of claim 1 wherein the means for mounting the bending assembly comprises a frame member and the first actuator is coupled between the frame member and the base block.

3. The bending machine of claim 2 wherein the first actuator comprises a servomotor.

4. The bending machine of claim 2 further comprising a shaft extending along said rotational axis, wherein said frame member comprises means for supporting said shaft, said bending dies are mounted on said shaft, and wherein said bending assembly comprises a swing frame supported by and rotatable about the axis of said shaft, said clamp dies being mounted on said swing frame, and further comprising means for moving said clamp dies toward and away from said bending dies.

5. The bending machine of claim 4 wherein said bending assembly further comprises a fixed carrier, pressure dies on said fixed carrier, and means for moving said pressure dies toward and away from a workpiece in said machine, said pressure dies being mounted to slidably engage said workpiece when the workpiece is clamped by said clamping dies and the swing frame is rotated about said axis.

6. The bending machine of claim 1 wherein said means coupling said second actuator comprises a carriage mounted for movement on said base block in said first direction on said base block, said second actuator being connected between said carriage and said holding and advancing means.

7. The bending machine of claim 6 further comprising motor means for moving said carriage in said first direction.

8. The bending machine of claim 7 further comprising a support mandrel movably mounted to said base block for supporting a workpiece held in said holding and advancing means, and a third actuator coupled between said base block and support mandrel for moving said mandrel in said third direction.

9. The bending machine of claim 8 further comprising means for moving said mandrel in said first direction.

10. The bending machine of claim 1 further comprising a support mandrel movably mounted to said base block for supporting a workpiece held in said holding and advancing means, and actuator means coupled between said base block and support mandrel for moving said mandrel in said third direction.

11. In a bending machine comprising a base block, a bending assembly, and feed means mounted on the base block for holding a length of a workpiece and advancing the workpiece in a first direction to the bending assembly, the bending assembly comprising means defining a rotational axis, a plurality of rotatable bend dies arranged along said rotational axis and a plurality of clamp dies movable toward and away from the bend dies, the bend dies and the clamp dies being adapted to hold the workpiece therebetween and bend the workpiece by rotating in unison about the rotational axis, the improvement comprising means for mounting said bending assembly to said base block for movement in a first plane perpendicular to and a first actuator coupled to said base block and means for mounting said bending assembly for moving the bending assembly in said first plane in a second direction transverse of said first direction, said feed means comprising a carrier mounted to said base block for movement in said first direction, means for moving said carrier in said first direction, workpiece holding means mounted on said carrier for movement in a third direction parallel to said rotational axis, and means for moving said holding means in said third direction.

12. The bending machine of claim 11 wherein said means for moving said holding means in said third direction comprises an actuator coupled between said carriage and said holding means.

13. The bending machine of claim 11 further comprising a support mandrel for supporting a workpiece held in said holding means, said mandrel being mounted to said base block for movement in said third direction, and means coupled between said mandrel and base block for moving said mandrel in said third direction.

* * * * *